US006154922A

United States Patent [19]

Vanderlinden

[11] Patent Number: 6,154,922

[45] **Date of Patent: *Dec. 5, 2000**

[54] SELF-PROPELLED FACTORY FLOOR CLEANING VEHICLE

[76] Inventor: Roger P. Vanderlinden, 73 Sherman Avenue S., Hamilton, Canada, L8M 2P8

[ * ] Notice: This patent is subject to a terminal disclaimer.

[21] Appl. No.: 09/371,793

[22] Filed: Aug. 10, 1999

Related U.S. Application Data

[63] Continuation-in-part of application No. 09/253,746, Feb. 22, 1999, abandoned.

[51] Int. Cl.[7] ..... A47L 5/14

[52] U.S. Cl. ..... 15/546; 15/340.3; 15/349

[58] Field of Search ..... 15/340.3, 346, 15/349

[56] References Cited

U.S. PATENT DOCUMENTS

| | | | |
|---|---|---|---|
| 1,207,816 | 12/1916 | Thompson | 15/346 |
| 4,858,270 | 8/1989 | Boschung | 15/346 |
| 4,951,347 | 8/1990 | Star et al. | 15/340.3 |
| 5,303,448 | 4/1994 | Hennessey et al. | 15/340.3 |
| 5,542,148 | 8/1996 | Young | 15/346 |
| 5,794,304 | 8/1998 | Ritter | 15/346 |
| 5,884,359 | 3/1999 | Libhart | 15/346 |

*Primary Examiner*—Terrence R. Till
*Assistant Examiner*—Theresa T. Snider

[57] ABSTRACT

A self-propelled factory floor cleaning vehicle has a cylindrically-shaped rotating sweeping broom to propel forwardly debris disposed on a contacted portion of a factory floor being cleaned, thereby creating a forwardly propelled stream of debris. A hopper is disposed to receive and retain the forwardly propelled stream of debris. A deflector flap is disposed forwardly of the rotating sweeping broom and immediately rearwardly of the hopper, to receive at least a portion of the forwardly propelled stream of debris and to deflect it upwardly and forwardly onto the hopper. An air blast outlet effects a blast of air forcefully impinges in a forward direction the floor behind the leading edge of the broom, thereby propelling forwardly therewith fine debris disposed on the factory floor, and carries forwardly through the sweeping broom and egresses therefrom, to deflect forwardly and upwardly off the deflector flap and forwardly past the deflector flap to travel to the hopper, in a path having a forward component along its entire length, exclusive of subsequent impingement of the factory floor and exclusive of subsequent re-entry into the lower portion of the rotating sweeping broom.

15 Claims, 4 Drawing Sheets

SELF-PROPELLED FACTORY FLOOR CLEANING VEHICLE

CROSS REFERENCE

This application is a Continuation-In-Part of application Ser. No. 09/253,746, filed Feb. 22, 1999 now abandoned.

FIELD OF THE INVENTION

The present invention relates to factory floor sweepers, and more particularly to self-propelled factory floor sweepers.

BACKGROUND OF THE INVENTION

The removal of dirt and debris from factory floors through the use of various types of factory type floor sweepers has been known for many years. The most common type of conventional self-propelled factory floor sweeper employs a horizontally disposed sweeping broom that sweeps dirt and debris forwardly directly into a hopper. It is well-known that such rotating sweeping brooms cannot clean dust properly from a factory floor, which is highly undesirable in an environmental sense, and also cannot clean dirt and debris from chipped and pocketed areas of a factory floor. Unless a scrubbing operation is performed, or in other words unless water is used, conventional self-propelled factory floor sweepers will leave matter, or other words dust, on the factory floor. However, scrubbing is generally undesirable, since it is time consuming and expensive. Further, hundreds of gallons of polluted water can be generated during the scrubbing of a large factory floor. Such polluted water must be disposed of properly, which is very inconvenient and can be very expensive.

In many jurisdictions, new legislation is presently being considered that reduces the size of the particles that must be contained to two and one half microns. Conventional self-propelled factory floor sweepers cannot effectively clean such small particulate matter unless a scrubbing operation is performed.

It is an object of the present invention to provide a self-propelled factory floor cleaning vehicle that sweeps the floor being cleaned with a sweeping broom first and then cleans small particulate matter from the floor.

It is another object of the present invention to provide a self-propelled factory floor cleaning vehicle that sweeps the floor being cleaned with a sweeping broom first and then cleans small particulate matter from the floor, without the use of water for dust suppression.

It is another object of the present invention to provide a. self-propelled factory floor cleaning vehicle that properly clens cracks and depressions in a factory floor.

SUMMARY OF THE INVENTION

In accordance with one aspect of the present invention, there is provided a novel self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "$W_B$" mounted on the vehicle for rotation about a horizontal axis of rotation and to propel forwardly from a floor contacting segment debris disposed on a contacted portion of a floor contacting segment being cleaned, the contacted portion being defined at its front by a leading edge, thereby creating a forwardly propelled stream of debris. A deflector flap means is disposed forwardly of the rotating sweeping broom, to receive at least a portion of the forwardly propelled. stream of debris and to deflect it upwardly and forwardly onto the debris retaining hopper. An air blast generating means effects a blast of air that forcefully impinges the floor behind the leading edge, thereby propelling forwardly therewith fine debris disposed. on the floor, and that carries forwardly through the rotating sweeping broom and egresses therefrom, to deflect forwardly and upwardly off the deflector flap means and forwardly past the deflector flap means to the debris retaining hopper.

In accordance with another aspect of the present invention, there is provided a novel self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "$W_B$" mounted on the vehicle for rotation about a horizontal axis of rotation and to propel forwardly from a floor contacting segment debris disposed on a contacted portion of a floor contacting segment, the contacted portion being defined at its front by a leading edge, thereby creating a forwardly propelled stream of debris. An air blast generating means effects a blast of air that forcefully impinges the floor behind the leading edge of the contacted portion thereby propelling forwardly therewith fine debris disposed on the floor, and that carries through the rotating sweeping broom and egresses therefrom to the debris retaining hopper, exclusive of subsequent re-entry into the lower portion of the rotating sweeping broom below the horizontal axis of rotation prior to reaching the debris retaining hopper.

In accordance with another aspect of the present invention, there is provided a novel self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "$W_B$" mounted on the vehicle for rotation about a horizontal axis of rotation and to propel forwardly from a floor contacting segment debris disposed on a contacted portion of a floor contacting segment, the contacted portion being defined at its front by a leading edge, thereby creating a forwardly propelled stream of debris. An air blast generating means effects a blast of air that forcefully impinges the floor behind the leading edge of the contacted portion thereby propelling forwardly therewith fine debris disposed on the floor, and that carries through the rotating sweeping broom and egresses therefrom to the debris retaining hopper, exclusive of subsequent impingement of the floor prior to reaching the debris retaining hopper.

In accordance with yet another aspect of the present invention, there is provided a novel self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "WB" mounted on the vehicle for rotation about a horizontal axis of rotation and to propel forwardly from a floor contacting segment debris disposed on a contacted portion of a floor contacting segment, the contacted portion being defined at its front by a leading edge, thereby creating a forwardly propelled stream of debris. An air blast generating means having a horizontally elongate air blast outlet of width "$W_O$" is disposed immediately rearwardly of the contacted portion of the floor for effecting a blast of air that forcefully impinges the floor behind the leading edge of the contacted portion thereby propelling forwardly therewith fine debris disposed on the floor, and that carries forwardly through the rotating sweeping broom and egresses therefrom, to the debris retaining hopper.

In accordance with yet another aspect of the present invention, there is provided a novel a self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "$W_B$" mounted on the vehicle for rotation about a horizontal axis of rotation and to propel forwardly from a floor contacting segment debris disposed on a contacted portion of a floor contacting segment, the contacted portion being defined at its front by a leading edge, thereby creating a forwardly propelled stream of debris. An air blast generating means effects a blast of air that forcefully impinges the floor behind the leading edge of the contacted portion thereby propelling forwardly therewith fine debris disposed on the floor, and that carries forwardly through the rotating sweeping broom and egresses therefrom, and travels in a path having a forward component along its entire length, to the debris retaining hopper.

In accordance with yet another aspect of the present invention, there is provided a novel self-propelled factory floor cleaning vehicle having a front end, a back end, a debris retaining hopper, and defining a medial longitudinal axis "L". The self-propelled factory floor cleaning vehicle comprises a cylindrically-shaped rotating sweeping broom of width "$W_B$" mounted on the vehicle for rotation about a horizontal axis of rotation and to propel forwardly from a floor contacting segment debris disposed on a contacted portion of a floor contacting segment, the contacted portion being defined at its front by a leading edge, thereby creating a forwardly propelled stream of debris. An air blast generating means effects a blast of air that forcefully impinges in a substantially forward direction the floor behind the leading edge of the contacted portion, thereby propelling forwardly therewith fine debris disposed on the floor, and that carries through the rotating sweeping broom and egresses therefrom, to the debris retaining hopper.

BRIEF DESCRIPTION OF THE DRAWINGS

The novel features which are believed to be characteristic of the self-propelled factory floor cleaning vehicle according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
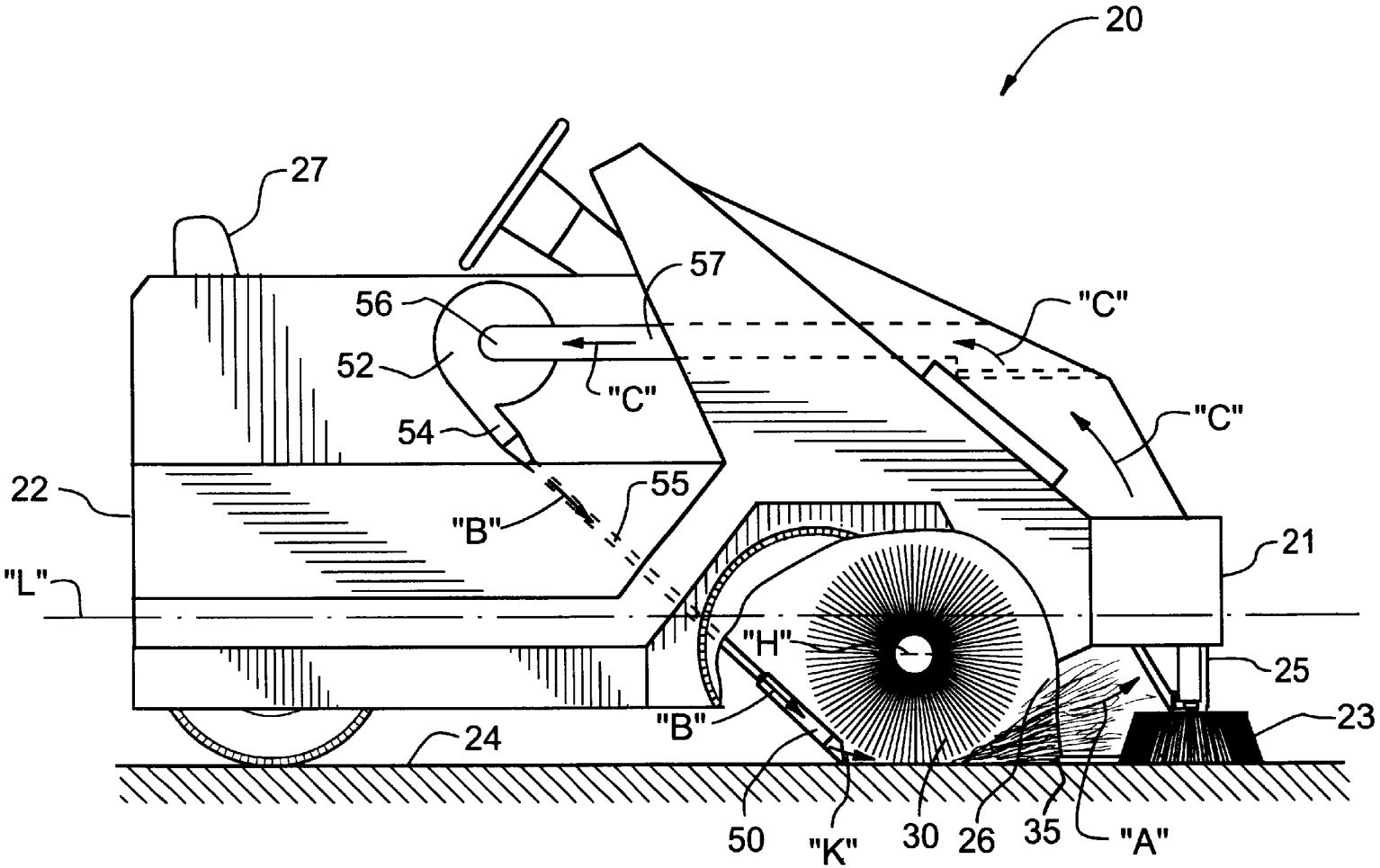
FIG. 1 is a side elevational view of a first preferred embodiment of the self-propelled factory floor cleaning vehicle according to the present invention, with a portion of the side of the self-propelled factory floor cleaning vehicles removed for the sake of clarity.
Figure 2:
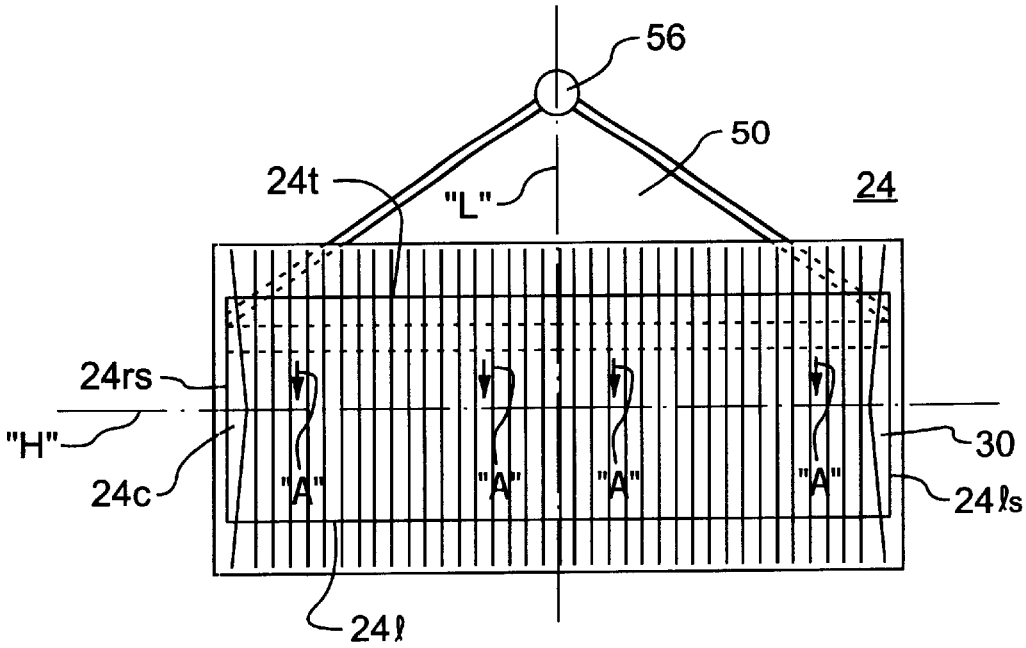
FIG. 2 is a sectional top plan view of a portion of the first preferred embodiment self-propelled factory floor cleaning vehicle of FIG. 1, taken along section line 2—2.
Figure 3:
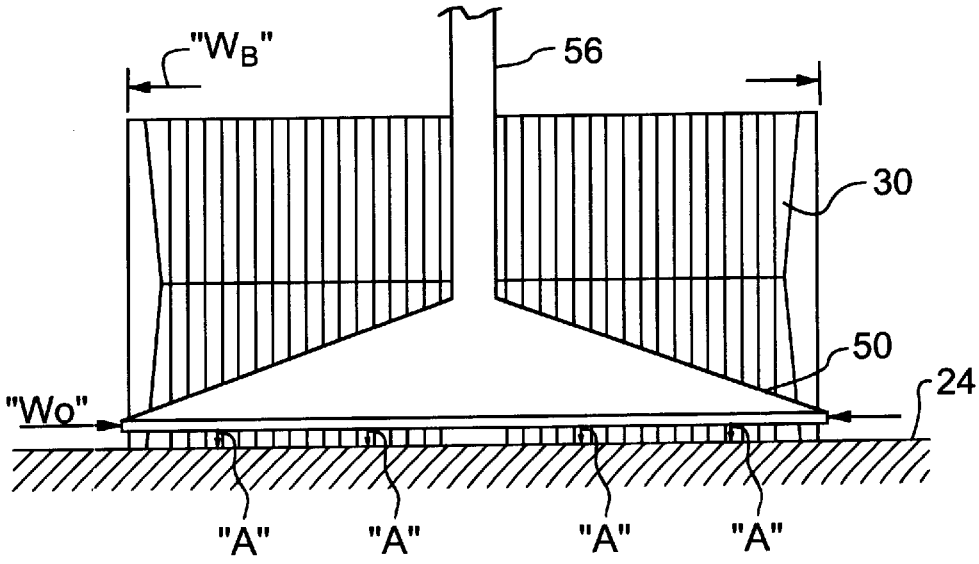
FIG. 3 is a back end elevational view of a portion of the first preferred embodiment self-propelled factory floor cleaning vehicle of FIG. 1, showing air blast chute, but with the broom cover shroud omitted for the sake of clarity; and, FIG. 4 is a side elevational view of a second preferred embodiment of the self-propelled factory floor cleaning vehicle according to the present invention, with a portion of the side of the self-propelled factory floor cleaning vehicle removed for the sake of clarity.

Reference will now be made to FIGS. 1 through 3, which show a first preferred embodiment of the self-propelled factory floor cleaning vehicle of the present invention, as indicated by general reference numeral 20. The self-propelled factory floor cleaning vehicle 20 has a front end 21 and a back end 22 and a generally centrally disposed longitudinal axis "L" extending between said front and back ends 21,22. A debris retaining hopper 25 is mounted on the self-propelled factory floor cleaning vehicle 20 forwardly of the driver's seat 27 and laterally across the longitudinal axis "L" and preferably across the width of the factory floor cleaning vehicle 20.

Two conventional counter-rotating brushes 23 (only one shown) are mounted on the self-propelled factory floor cleaning vehicle 20 to brush debris on a floor 24 being cleaned, and to brush the debris inwardly toward the generally centrally disposed longitudinal axis "L". More specifically, debris along walls, shelving units, posts, and so on, is moved so it can be subsequently captured.

A cylindrically-shaped rotating sweeping broom 30 of width "$W_B$" is mounted on the self-propelled factory floor cleaning vehicle 20 mounting arms (not shown) so as to be disposed laterally across the longitudinal axis "L", of the self-propelled factory floor cleaning vehicle 20, for selective rotation about a substantially horizontal axis of rotation "H" by means of suitable bearings (not shown) in floor tracking relation, or in other words, to have a floor contacting segment 30*s*, that engages in sweeping relation a contacted portion 24*c* of the floor 24 being cleaned, and to propel forwardly debris disposed on the contacted portion 24*c* of the floor 24 being cleaned, thereby creating a forwardly propelled stream of debris. The contacted portion 24*c* is defined by a leading edge 24*t*, a trailing edge 24*l*, a left side edge 24*ls*, and a right side edge 24*rs*.

The hopper 25 is positioned on the self-propelled factory floor cleaning vehicle 20 to receive and retain the forwardly propelled stream of debris thereinto through a rearwardly facing opening 26, as indicated by arrow "A" in FIG. 1.

A deflector flap means comprising a deflector flap 35 is secured to the self-propelled factory floor cleaning vehicle 20 at the bottom of the rearwardly facing opening 26 of the hopper 25 as to be disposed immediately forwardly of and substantially parallel to the rotating sweeping broom 30, and immediately rearwardly of the rearwardly facing opening 26 of the hopper 25. The deflector flap 35 receives at least a portion of the forwardly propelled stream of debris, and deflects the forwardly propelled stream of debris upwardly and forwardly into the hopper 25. The deflector flap 35 also substantially precludes the forwardly propelled stream of debris from passing forwardly under the hopper 25.

An air blast generating means comprises a horizontally elongate air blast outlet 50 and a main fan 52. The horizontally elongate air blast outlet 50 is mounted on the self-propelled factory floor cleaning vehicle 20 so as to be disposed immediately rearwardly of the floor contacting segment 30*s* of the rotating sweeping broom 30, and therefore be disposed immediately rearwardly of the contact portion 24*c* of the floor 24 being cleaned. As can be best seen in FIG. 3, the horizontally elongate air blast outlet 50 has a width "$W_O$" that is substantially coincident with the width "$W_B$" of the rotating sweeping broom 30. As can be best seen in FIG. 1, the air blast outlet 50 is connected in fluid communication to an air flow supply comprising the main fan 52, so as to receive air therefrom, and to effect a blast of air, as indicated by arrow "K" in FIG. 1, that impinges off a portion of the floor 24 being cleaned immediately behind the contacted portion 24*c* of the floor 24 being cleaned, which is contacted by the floor contacting segment 30*s* of the rotating sweeping broom 30, as can be best seen in FIG. 1A. The blast of air continues through the lower portion of the rotating sweeping broom 30 and enters the debris retaining hopper 25 along with debris cleaned from the floor 24, as indicated by arrow "I" in FIG. 1.

In the first preferred embodiment, as illustrated, the main fan 52 is mounted on the self-propelled factory floor cleaning vehicle 20 rearwardly of the hopper 52. The outlet 54 of the main fan 52 is connected in fluid communication via a flexible pipe 55 with the horizontally elongate air blast outlet 50. The inlet 56 of the main fan 52 is connected in fluid communication with the hopper 25 through an air supply pipe 57.

Figure 1A:
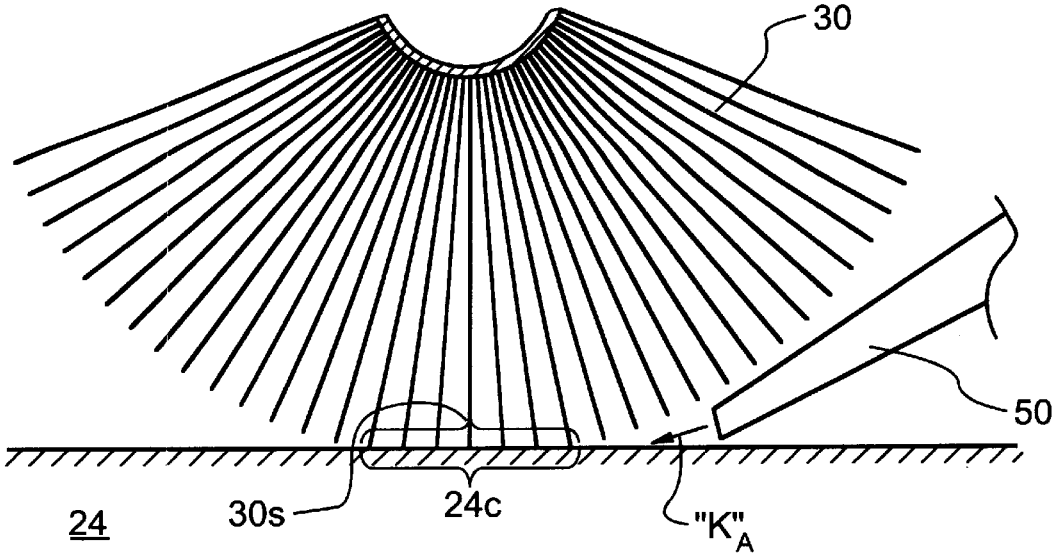
FIG. 1A is an enlarged side elevational view of a portion of the first preferred embodiment self-propelled factory floor cleaning vehicle of FIG. 1, with the air blast outlet aimed immediately behind the contacted portion of the floor contacting segment, as contacted by the floor contacting segment of the rotating sweeping broom.
Figure 1B:
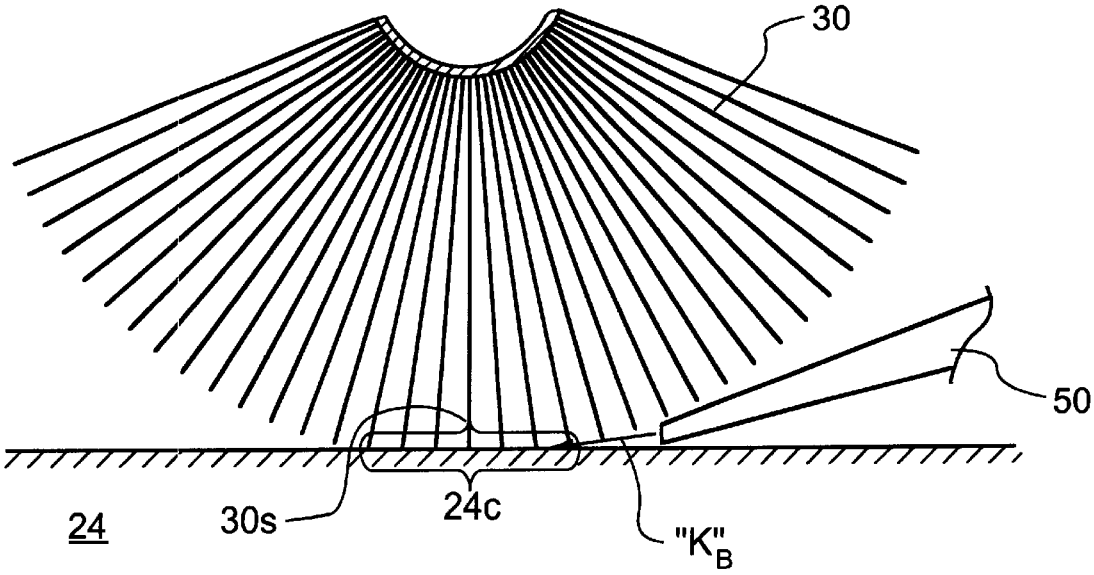
FIG. 1B is an enlarged side elevational view of a portion of the first preferred embodiment self-propelled factory floor cleaning vehicle of FIG. 1, with the air blast outlet aimed at the contacted portion of the floor contacting segment, as contacted by the floor contacting segment of the rotating sweeping broom.

The horizontally elongate air blast outlet 50 is positioned immediately rearwardly of the rotating sweeping broom 30 and is oriented to effect a blast of air at the floor 24 being cleaned behind the leading edge 241 in a substantially forward direction. As is shown in FIG. 1A, the air blast outlet 50 is positioned and oriented such that the air blast impinges off a portion of the floor 24 being cleaned immediately behind the contacted portion 24*c* of the floor 24 being cleaned, which is contacted by the floor contacting segment 30*s* of the rotating sweeping broom 30. As is shown in FIG. 1B, the air blast outlet 50 is positioned and oriented such that the air blast impinges off the contacted portion 24*c* of the floor 24 being cleaned, which is contacted by the floor contacting segment 30*s* of the rotating sweeping broom 30.

In any event, the blast of air thereby propels forwardly therewith fine debris disposed on the floor 24 being cleaned, and continues to flow forwardly and to carry forwardly through the rotating sweeping broom 30 and egresses therefrom. Further, the blast of air carries through the rotating sweeping broom 30 exclusive of subsequent re-entry into the lower portion of the rotating sweeping broom 30 below the horizontal axis of rotation "H", and exclusive of subsequent impingement of the floor 24 being cleaned, prior to reaching the hopper 25. In other words, the blast of air from the air blast outlet 50 passes through the lower portion of the rotating sweeping broom 30 once only, and does not carry back rearwardly around the rotating sweeping broom 30. The blast of air thereby propels debris disposed on the floor 24 being cleaned forwardly into the forwardly propelled stream of debris, thus augmenting the cleaning of the floor 24 being cleaned. After the air blast egresses from the rotating sweeping broom 30, it travels in a path having a forward component along its entire length, and it deflects forwardly and upwardly off the deflector flap 35, and continues forwardly past the deflector flap 35, to the hopper 25.

In use, the self-propelled factory floor cleaning vehicle 20 travels forwardly and debris passes under the deflector flap 35, and is then swept forwardly by the rotating sweeping broom 30 onto the hopper 25. Any fine particle debris, or in other words dust, that is missed by the rotating sweeping broom 30 is blown forwardly through the broom by the horizontally elongate air blast outlet 50, as is best seen in FIGS. 1 through 3. The horizontally elongate air blast outlet 50 receives air from the main fan 52 through the flexible pipe 55, as indicated by arrows "B" in FIG. 1. The main fan 52, in turn, draws air from the hopper 25, as indicated by arrows "C".

Figure 4:
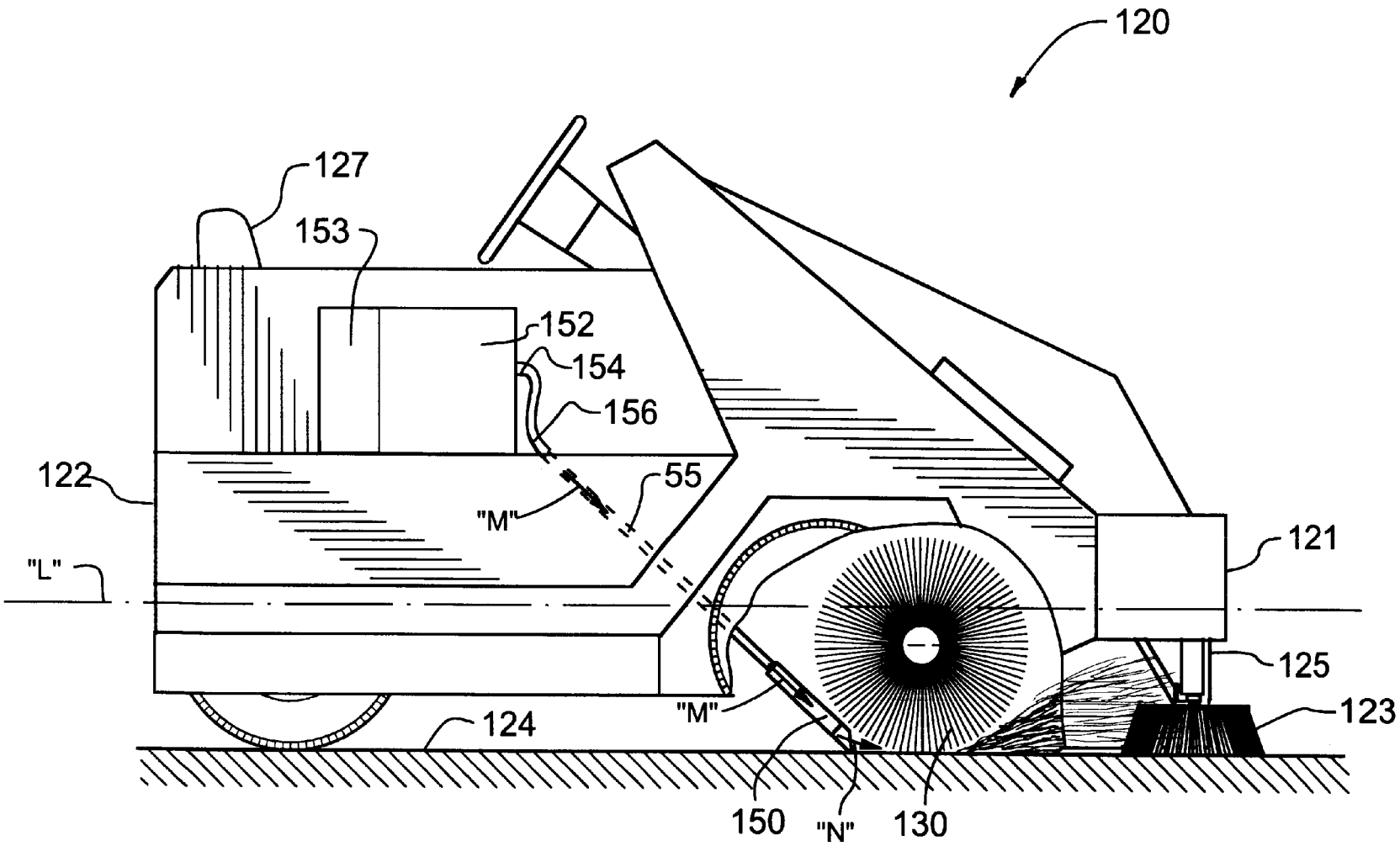

Reference will now be made to FIG. 4, which shows a second preferred embodiment of the self-propelled factory floor cleaning vehicle of the present invention as indicated by the general reference numeral 120, which self-propelled factory floor cleaning vehicle 120 is similar to the self-propelled factory floor cleaning vehicle 20 disclosed in the first preferred embodiment. The self-propelled factory floor cleaning vehicle 120 has a front end 121 and a back end 122 and a generally centrally disposed longitudinal axis "L" extending between said front and back ends 121,122. A debris retaining hopper 125 is mounted on the self-propelled factory floor cleaning vehicle 120 forwardly of the driver's seat 127 and laterally across the longitudinal axis "L" and preferably across the width of the self-propelled factory floor cleaning vehicle 120.

Two conventional counter-rotating brushes 123 (only one shown) are mounted on the self-propelled factory floor cleaning vehicle 120 to brush debris on a floor 124 being cleaned, and to brush the debris inwardly toward the generally centrally disposed longitudinal axis "L". More specifically, debris along walls, shelving units, posts, and so on, is moved so it can be subsequently captured.

A rotating sweeping broom 130 is mounted on the self-propelled factory floor cleaning vehicle 120 in floor tracking relation by means of suitable mounting arms (not shown), so as to permit the self-propelled factory floor cleaning vehicle 120 to follow a factory floor, and to propel forwardly debris disposed on a floor 124 being cleaned, thereby creating a forwardly travelling stream of debris that is propelled directly into the hopper 125.

A horizontally elongate air blast outlet 150 is mounted on the self-propelled factory floor cleaning vehicle 120, so as to terminate immediately behind the sweeping broom 130. The horizontally elongate air blast outlet 150 is connected in fluid communication to an air flow supply comprising an air compressor 152 driven by an electrically or hydraulically powered motor 153. The outlet 154 of the air compressor 152 is connected in fluid communication via a flexible pipe 156 with the horizontally elongate air blast outlet 150. The air blast outlet 150 receives air from the air compressor 152 as indicated by arrows "M", and effects a blast of air toward the lower portion of the sweeping broom 130, as indicated by arrow "N". The blast of air impinges off a portion of the floor 124 being cleaned immediately behind the sweeping broom 130, and carries through the sweeping broom 130, thereby propelling debris disposed on the floor 124 being cleaned forwardly into the forwardly travelling stream of debris, thus augmenting the cleaning of the floor 124.

Alternatively, it is contemplated that a main fan and an air compressor could be used in conjunction with each other.

As can be understood from the above description and from the accompanying drawings, the self-propelled factory floor cleaning vehicle according to the present invention is inventive over prior art floor sweepers in that it sweeps a floor with a sweeping broom and cleans small particulate matter from the floor, without the use of water for dust suppression, which is otherwise unknown in the industry.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

a deflector flap means disposed forwardly of said rotating sweeping broom, to receive at least a portion of said forwardly propelled stream of debris and to deflect it upwardly and forwardly onto said debris retaining hopper; and, air blast generating means in direct connection with a horizontally elongate air blast outlet of width ($W_O$) for effecting a blast of air that forcefully impinges said floor behind said leading edge, thereby propelling forwardly therewith fine debris disposed on said floor, and that carries forwardly through said rotating sweeping broom and egresses therefrom, to deflect forwardly and upwardly off said deflector flap means and forwardly past said deflector flap means to said debris retaining hopper.

2. The self-propelled factory floor cleaning vehicle of claim 1, wherein said blast of air carries through said rotating sweeping broom exclusive of subsequent re-entry into the lower portion of said rotating sweeping broom below said horizontal axis of rotation, prior to reaching said debris retaining hopper.

3. The self-propelled factory floor cleaning vehicle of claim 1, wherein said blast of air forcefully impinges said floor behind said leading edge and carries through said rotating sweeping broom to said debris retaining hopper exclusive of subsequent impingement of said floor, prior to reaching said debris retaining hopper.

4. The self-propelled factory floor cleaning vehicle of claim 1, wherein said air blast outlet is disposed immediately rearwardly of said contacted portion of said floor.

5. The self-propelled factory floor cleaning vehicle of claim 4, wherein said air blast outlet is positioned and oriented to aim said blast of air to impact at said contacted portion of said floor.

6. The self-propelled factory floor cleaning vehicle of claim 4, wherein said air blast outlet is positioned and oriented to aim said blast of air to impact behind said contacted portion of said floor.

7. The self-propelled factory floor cleaning vehicle of claim 4, wherein said width ($W_O$) of said horizontally elongate air blast outlet is substantially coincident with said width ($W_B$) of said rotating sweeping broom.

8. The self-propelled factory floor cleaning vehicle of claim 1, wherein said blast of air carries forwardly through said rotating sweeping broom, and travels in a path having a forward component along its entire length, to said debris retaining hopper.

9. The self-propelled factory floor cleaning vehicle of claim 1, wherein said blast of air forcefully impinges said floor in a substantially forward direction.

10. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

air blast generating means in direct connection with a horizontally elongate air blast outlet of width ($W_O$) for effecting a blast of air that forcefully impinges said floor behind said leading edge of said contacted portion thereby propelling forwardly therewith fine debris disposed on said floor, and that carries through said rotating sweeping broom and egresses therefrom to said debris retaining hopper, exclusive of subsequent re-entry into the lower portion of said rotating sweeping broom below said horizontal axis of rotation prior to reaching said debris retaining hopper.

11. The self-propelled factory floor cleaning vehicle of claim 10, further comprising a deflector flap means disposed forwardly of said rotating sweeping broom, wherein said blast of air carries forwardly through said rotating sweeping broom to deflect forwardly and upwardly off said deflector flap means and forwardly past said deflector flap means to said debris retaining hopper.

12. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

air blast generating means in direct connection with a horizontally elongate air blast outlet of width ($W_O$) for effecting a blast of air that forcefully impinges said floor behind said leading edge of said contacted portion thereby propelling forwardly therewith fine debris disposed on said floor, and that carries through said rotating sweeping broom and egresses therefrom to said debris retaining hopper, exclusive of subsequent impingement of said floor prior to reaching said debris retaining hopper.

13. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

air blast generating means in direct connection with a horizontally elongate air blast outlet of width ($W_O$) disposed immediately rearwardly of said contacted portion of said floor for effecting a blast of air that forcefully impinges said floor behind said leading edge of said contacted portion thereby propelling forwardly therewith fine debris disposed on said floor, and that carries forwardly through said rotating sweeping broom and egresses therefrom, to said debris retaining hopper.

14. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

air blast generating means in direct connection with a horizontally elongate air blast outlet of width ($W_O$) for effecting a blast of air that forcefully impinges said floor behind said leading edge of said contacted portion thereby propelling forwardly therewith fine debris disposed on said floor, and that carries forwardly through said rotating sweeping broom and egresses therefrom, and travels in a path having a forward component along its entire length, to said debris retaining hopper.

15. A self-propelled factory floor cleaning vehicle having a front end, a back end, a debris retaining hopper, and defining a medial longitudinal axis (L), said self-propelled factory floor cleaning vehicle comprising:

a cylindrically-shaped rotating sweeping broom of width ($W_B$) mounted on said vehicle for rotation about a horizontal axis of rotation and to propel forwardly from a floor contacting segment debris disposed on a contacted portion of a floor contacting segment, said contacted portion being defined at its front by a leading edge, thereby creating a forwardly propelled stream of debris;

air blast generating means in direct connection with a horizontally elongate air blast outlet of width ($W_O$) for effecting a blast of air that forcefully impinges in a substantially forward direction said floor behind said leading edge of said contacted portion, thereby propelling forwardly therewith fine debris disposed on said floor, and that carries through said rotating sweeping broom and egresses therefrom, to said debris retaining hopper.

* * * * *